United States Patent [19]

Kaplan

[11] 3,997,860

[45] Dec. 14, 1976

[54] MINIATURE MEMORY BIT HOLDER HAVING ARMATURE PRONGS SELECTIVELY PIERCING THE ASSOCIATED CONTACTS

[76] Inventor: Jonathan Todd Kaplan, 237 E. 20th St., New York, N.Y. 10003

[22] Filed: Sept. 25, 1975

[21] Appl. No.: 616,558

[52] U.S. Cl. ..... 335/154; 335/157

[51] Int. Cl.[2] ..... H01H 1/66; H01H 51/00

[58] Field of Search ..... 335/151, 152, 153, 154, 335/79, 157, 158; 200/239, 244, 262, 264

[56] References Cited

UNITED STATES PATENTS

| | | | |
|---|---|---|---|
| 2,406,036 | 8/1946 | Pollard | 335/154 X |
| 2,641,670 | 6/1953 | Graves | 200/264 |
| 3,254,327 | 5/1966 | Freimanis et al. | 335/79 X |
| 3,735,068 | 5/1973 | Yanaga et al. | 200/264 X |

*Primary Examiner*—George Harris
*Attorney, Agent, or Firm*—Murray Schaffer

[57] ABSTRACT

A miniature memory bit holder which is provided with a movable armature having two sharp prongs mounted on opposite sides of the armature in opposition to one or a pair of fixed contacts. When the armature is moved the sharp prongs are adapted to pierce the fixed contact and remain embedded therein.

An electromagnet is employed to move the armature. The armature and fixed contact may be housed in a container.

9 Claims, 1 Drawing Figure

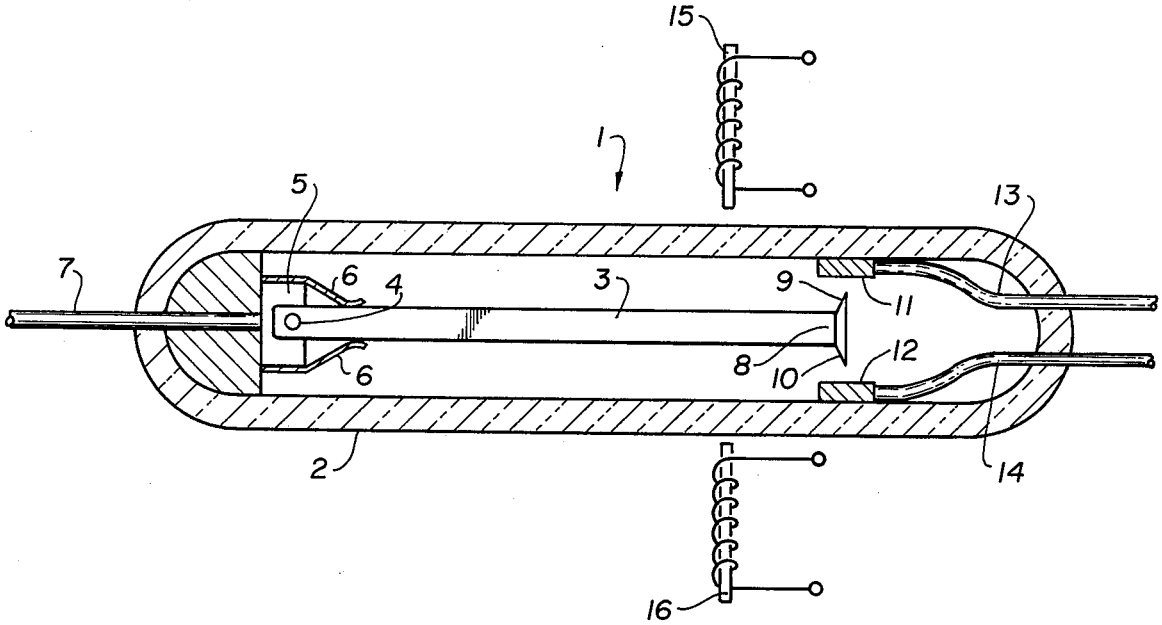
15
1
5
13
7
6
4
3
9
11
6
8
10
12
2
14
16

MINIATURE MEMORY BIT HOLDER HAVING ARMATURE PRONGS SELECTIVELY PIERCING THE ASSOCIATED CONTACTS

BACKGROUND OF THE INVENTION

The present invention relates broadly to what are classified as switch devices by which electric contact, in electric circuits can be made and in particular to a memory bit holder by which such devices may be held in any given mode so as to be capable of use as a relay or selectively operable control device, in numerous applications.

Switch devices are known for use in electrical control circuits of various types, having movable armatures or blades which are activated, as by the use of electromagnetic means to establish engagement with a fixed contact. However, when the electromagnet is deenergized, the contact is caused to break engagement in the circuit, or is caused by the use of suitable springs to return to its original position. In some instances, spring means, lever arms or means to maintain the electromagnet permanently energized are employed to "lock" the armature in contact position, pending its withdrawal or movement under an additional electromagnetic energization.

The known devices are therefore of only limited usefullness or are of such complex construction as to be relatively expensive and therefore uneconomical in all but high price mechanisms.

It is an object of the present invention to provide a swich device which is simple and economical, avoiding the disadvantage of the known devices and which has wide applicaation.

It is another object of the present invention to provide the electromagnetically operable switch device having a memory, which may be used for computer memories, automatic switching devices, computer logic circuits, burglar alarms, relays, home appliances, and most any other application where simple, low cost switching operations are required.

These objects as well as other objects, together with the numerous advantages of the present invention will be apparent from the following disclosure of the present invention.

SUMMARY OF THE PRESENT INVENTION

According to the present invention, there is provided a casing in which is pivotally mounted an armature, at the free end of which is located a sharply pointed prong while at the pivoted end is connected a lead wire extending therefrom. Mounted at the other end of the casing and spaced laterally from the armature in line with tthe prong is a wad of metal serving as a fixed contact. The wad of metal is formed so as to be able to be pierced by the sharp prong of the armature and to hold it therein indefinitely, creating sufficient engaging force or friction on the prong, once it is pierced to maintain the armature in pivoted position. The armature is pivotable by a remotely controlled, selectively operable magnetic means such as an electromagnet, although a permanent magnet or other means for moving the armature may be used.

It is preferred to provide the armature with a pair of prongs positioned on opposite sides thereof in the pivoting plane, and the casing with a pair of correspondingly placed contact wads. The first wad of metal lies on the opposite side of the armature as the second wad of metal. Located outside of the casing are two electromagnets that lie on opposite sides of the armature so that when one is energized, the armature will pivot into engagement with the fixed contact on the side of the casing nearest the energized electromagnet, and be held there even after deenergization of the magnet and until removed by energization of the other opposing magnet.

The device of the present invention is given a memory by the fact that the end of the armature which contacts the fixed contacts is provided with the sharp metal prongs which will impinge upon and pierce at least the surface of the respective metal wad and be held therein. Thus, when the magnet means which pivots the armature is deenergized, the prong which pierced the fixed contact remains stuck therein so that the armature will not return to its neutral position. Therefore, a memory is achieved in the electromagnetic relay of the present invention, which allows it to serve as a memory bit holder.

Full details of the present invention are set forth in the following description and will be seen from the attached drawing.

BRIEF DESCRIPTION OF THE DRAWING

The FIGURE is a schematic illustration of an embodiment of the switch device of the present invention, in plan view.

DETAILED DESCRIPTION OF THE INVENTION

The switch device of the present invention is illustrated in the drawing, as being embodied in a miniature memory bit holder, generally indicated by numeral 1. The memory bit holder 1 comprises a casing 2 on which an armature 3 is pivotally connected at one end by a hinge pin 4 having a pivot axis extending transversely to the plane of the paper on which the figure is drawn so that the armature, as illustrated will swing parallel to that plane. Mounted adjacent to the hinge 4 and in contact with the armature 3 is a contact plate 5, having two metal flaps 6. Extending from the metal plate 5 is a first lead wire 7, which extends outwardly from the casing 2 for connection to a desired circuit element such as an electrical source. If desired the lead wire 7 can be connected directly to the hinge pin 4, which would be conductive and in electrical contact with the armature.

The free end of the armature 3 (i.e. the end opposite to the pivoted end) is provided with a contact head 8, which is formed with two sharp metal prongs 9 and 10. These two sharp metal prongs are provided on opposite sides of the contact head 8 as shown in the drawing and have pointed ends lying at least in the plane of swing of the armature.

Mounted on the casing 2 in close proximity to each of the sharp prongs 9 and 10 are fixed contacts 11 and 12 made of wads of metal. The fixed contacts 11 and 12 are spaced as close to the sharp prong 9 and 10, respectively as possible, given the known design electrical characteristics of the device and the need to avoid arcing prior to contact. A small fraction of an inch, will generally be sufficient. Extending from each of the fixed contacts 11 and 12 are lead wires 13 and 14, respectively, which extend outwardly from the casing 2 as shown in the drawing. Lead wires 13 and 14 are connected with any suitable circuit element determined only by the use of the present invention.

The casing may be an open framework, although it is preferred that it be an elongated tubular member capable of being sealed or closed, as illustrated at each end. It may be made of glass, platic, non-conductive metal, or similar materials. It may also be evacuated of air, if desired, although this is not really necessary, except when the device is employed in applications where the effect of dirt, duct etc. may be critical.

The armature 3, as illustrated, is adapted to swing under impulse of an external force between contact wads 11 and 12 depending on the direction of force. Such impetus can be obtained by placing a permanent magnet adjacent the casing 2 at selected times. However, in order to provide a flexible, automatic and truely selectively operable device, it is preferred to employ remote controlled electromagnets, solenoids, or solid state magnetic producing devices. As seen in the figure, for example, there are mounted on opposite sides of the casing 2, and outside thereof, two electromagnets 15 and 16. Electromagnet 15 is mounted on the side of the casing where the fixed contact wad 11 is mounted, and electromagnet 16 is mounted on the other side of the casing where the fixed contact wad 12 is mounted.

The metal contact wads 11 and 12 must be formed so as to be pierced by the sharp prongs of the armature contact, and when so pierced to exert a sufficient frictional or compressive force on the prongs to hold the armature in its deflected position. The metallic wad forming the contacts can be formed from a mass of soft metal, such as lead or sintered iron filings, which is sufficiently porous or opened-celled to permit the sharp edge of the prong 9 to embed itself within it. In addition, the contact wad can be formed of a bundle of parallel wires bound together by a peripheral wall, or even sintered together, which wires lie perpendicular to the axis of the armature so that the prong can embed itself between two or more of the wires. It is also possible to form the contact wad out of a central body or core of metal, to which the lead wire is connected, and which itself is embedded in a soft resinous material of sufficient thickness to permit the sharp contact point to become embedded and held therein while making contact with the metallic core.

The armature contacts, (i.e. at least the sharp pointed ends), are preferably made of hard metal capable of being sharpened to a defined point by which the point under extensive repeated use may continue to be held by the contact wad. Suitable metals such as iron, steel, copper brass and other highly conductive metals may be used for the contact point as well as for the contact wad. The armature and prongs may also, if desired, be stamped from inexpensive material, and periodically replaced, when worn, rather than being made of more expensive material requiring periodic sharpening. The armature can be made of iron, steel, or other conductive material. Because of its relative shortness, very little electrical resistance occurs and the choice of material need not necessarily be limited by electrical parameters.

When one of the electromagnets 15 and 16 is energized, the armature 3 will pivot in response to the magnetic field set up.

The strength of the electromagnet should be chosen so that a sufficient magnetic field is created which would swing the armature 3 so that it will not only contact the respective fixed contacts 11 or 12, but will pierce at least its surface and become lodged therein and hold by frictional or compressive forces only the electromagnets illustrated as being mounted on the exterior of the casing. They may of course be mounted within the casing, on the casing, or even separately from the casing. The strength of the magnet can be easily chosen from conventional and suitable iron core, movable core, or coreless electromagnet solenoids. Many are available having the strength and time response capable of application herein.

In operation, the device is connected in the circuit, in conventional manner, (i.e. leads 7,, and 13, 14) to appropriate connections, and the actuating electromagnets 15 and 16 to the necessary control units. When, for example, electromagnet 15 is thereafter energized, armature 3 will pivot toward the fixed contact 11 and will become lodged therein due to the sharp prong 9 thereby completing electrical contact allowing current to pass between lead wire 7 and lead wire 13. Even after deenergization of the electromagnet 15, the metal prong will remain lodged in the fixed contact 11, thereby affording a permanent memory without continued activation of the impulse magnets. The sharp prong will only be dislodged by the energization of the other electromagnet 16 forcing the armature 3 away from the fixed contact 11 and toward the fixed contact 12. Connection with the fixed contact 12 allows current to pass between lead wire 7 and lead wire 14. Here, again the sharp metal prong 10 will become lodged in the fixed contact 12 in the same manner as the sharp prong 9 is lodged in the fixed contact 11.

It can be seen, therefore, that the device of the present invention not only acts as an electromagnetic relay, but as a memory bit holder, where even after deenergization of the electromagnets, contact will be made with one of the fixed contacts.

The electromagnets are shown as electromagnets having iron cores. Other magnets may be used. Their connection to a source of current, suitable actuating means, and their placement within the appropriate control circuitry will conventionally follow from those applications now in current use. It will be appreciated, that in addition to the individual actuation of each of the magnets 15 and 16, the magnets may be actuated in opposite modes jointly to provide a push-pull effect from both sides of the armature simultaneously.

Because of the design of the present invention, the device may be miniaturized to a very small size. For example, the casing 2 may be made only about an inch in length.

Although this invention has been described with reference to specific forms and embodiments thereof, it will be apparent to those skilled in the art that various changes other than those referred to above may be made in the form of the device, that equivalent elements may be substituted for those illustrated in the drawing, that parts may be reversed, and that certain features of the invention may be used to advantage independently of the use of other features, all within the spirit and scope of the invention as defined in the appended claims.

What is claimed is:

1. A switch device comprising a casing, an armature mounted on said casing for movement within a given plane, means mounting said armature for said movement and having a lead wire extending therefrom through a first end of said casing; a fixed contact mounted on said casing in said plane of movement and to the side of said armature, said fixed contact having a lead wire extending therefrom; said armature having at its free end a contact comprising a sharp metal prong extending in a direction toward said fixed contact; and means for selectively moving said armature toward and away from said fixed contact; said fixed contact being formed so as to be pierced by said prong permitting said prong to become embedded therein on contact therewith.

2. The device according to claim 1, wherein said armature is provided with a pair of prongs arranged on opposite sides thereof in the plane of movement and said casing is provided with a pair of fixed contacts arranged in the plane of movement in opposition to said prongs.

3. The device according to claim 1 wherein said means for moving said armature comprises a magnet.

4. The device according to claim 3 wherein said magnet comprises an electromagnet remotely activated.

5. The device according to claims 2 including a pair of remotely activated electromagnets arranged on opposite sides of said armature.

6. The electromagnetic relay according to claim 1, wherein said means for mounting said armature in said casing comprises a hinge, and said armature is connected at one end to said hinge for pivotal movement about an axis perpendicular to the plane of movement.

7. The electromagnetic relay according to claim 1, wherein said casing is made of glass, and is about an inch in length.

8. The electromagnetic relay according to claim 4, wherein the distance between one of said fixed contacts and the respective one of said sharp prongs is a fraction of an inch.

9. The electromagnetic relay according to claim 1, wherein said means for mounting said armature within said casing comprises a pair of metal flaps.

* * * * *